US005513568A

United States Patent [19]

Hoffman et al.

[11] Patent Number: 5,513,568

[45] Date of Patent: May 7, 1996

[54] PLATE CYLINDER FOR A SLEEVE-TYPE PRINTFORM

[75] Inventors: Eduard Hoffman, Bobingen; Wolfgang Prem, Kutzenhausen; Alfons Grieser, Sielenbach; Johann Winterholler, Firedberg, all of Germany

[73] Assignee: MAN Roland Druckmaschinen AG, Offenbach am Main, Germany

[21] Appl. No.: 349,528

[22] Filed: Dec. 5, 1994

[30] Foreign Application Priority Data

Dec. 10, 1993 [DE] Germany ..... 43 42 159.8

[51] Int. Cl.[6] ..... B41F 13/08

[52] U.S. Cl. ..... 101/375; 492/18; 492/28

[58] Field of Search ..... 101/375, 378, 101/382.1, 383, 389.1, 409, 415.1, 376, 480; 492/18, 22, 25, 27, 28, 47, 48; 37/452, 453, 460

[56] References Cited

U.S. PATENT DOCUMENTS

| | | | |
|---|---|---|---|
| 4,030,415 | 6/1977 | Fellows | 101/382.1 |
| 4,089,265 | 5/1978 | White et al. . | |
| 4,144,813 | 3/1979 | Julian | 101/382.1 |
| 4,381,588 | 5/1983 | Biondetti | 492/7 |
| 4,963,404 | 10/1990 | Jenkins | 101/348 |
| 5,111,600 | 5/1992 | Lukavich et al. | 37/460 |
| 5,379,693 | 1/1995 | Hoffman et al. | 101/375 |

FOREIGN PATENT DOCUMENTS

| | | |
|---|---|---|
| 546973 | 6/1993 | European Pat. Off. . |
| 2542748 | 4/1976 | Germany . |
| 4106062 | 6/1992 | Germany . |
| 4140768 | 6/1993 | Germany . |
| 57-107844 | 7/1982 | Japan . |
| 57-107843 | 7/1982 | Japan . |
| 1483371 | 8/1977 | United Kingdom . |
| 1581232 | 12/1980 | United Kingdom . |

*Primary Examiner*—Edgar S. Burr
*Assistant Examiner*—Eric P. Raciti
*Attorney, Agent, or Firm*—Cohen, Pontani, Lieberman, Pavane

[57] ABSTRACT

A plate cylinder for a sleeve-type printform, particularly an aluminum offset printform, with a ramp-like transition piece as a guide surface for the mechanical expansion of the sleeve-type printform onto the larger cylinder diameter. At least the surface area of the plate cylinder that is covered by the ramp-like transition piece has a highly wear-resistant and pressure-resistant slide surface of a material different from the remaining surface material of the plate cylinder to prevent abrasion when the printform is slipped onto the plate cylinder.

10 Claims, 3 Drawing Sheets

PLATE CYLINDER FOR A SLEEVE-TYPE PRINTFORM

BACKGROUND OF THE INVENTION

1. Field of the Invention

The invention relates to a plate cylinder for a sleeve-type printform, particularly an offset printform at least partially made of aluminum, with a ramp-like phase piece as a guide surface for the mechanical expansion of the sleeve-type printform onto the larger cylinder diameter.

2. Description of the Prior Art

A plate cylinder of this type without channel and span segments, which can be used together with a sleeve-type a printform, is already known, for example, from German patent DE 41 06 062 C1. In order to place the printform onto the plate cylinder, the printform must be precentered on an end face of the plate cylinder. The sleeve-type printform is subsequently slipped on to the plate cylinder while being expanded by pressurized air. Stopping the pressurized air causes the sleeve to be placed on the cylinder in a form-fitting fashion, in the manner of a shrinkage fit. The sleeve can be removed from the cylinder by resuming the supply of pressurized air. The body of the cylinder preferably has a chrome coating to protect against corrosion.

In a manner which has been used for years in flexographic printing with galvanically-produced nickel sleeves, the sleeve, the inner diameter of which is smaller than the cylinder diameter of the carrying part, is expanded after precentering by means of a ramp-like transition piece of the cylinder body, so that the sleeve can be slipped completely onto the body of the cylinder over an air cushion.

The type of printform used most often in offset printing is the precoated aluminum plate, the great advantage of which is the simplicity and rapidity of its production. A sleeve-type printform which is made from an aluminum plate is known from the German patent application P 41 40 768.7. However, slipping the sleeve-type aluminum printform onto the coated cylinder can cause abrasion to the printform, which in turn may effect print quality.

The two materials used, respectively, for the printform and for the corrosion protection of the plate cylinder should both be retained, since aluminum is currently the established material for printforms and since chrome has proved itself preferable as protection against corrosion from current printing media.

SUMMARY OF THE INVENTION

Accordingly, it is an object of the present invention to further improve a generic plate cylinder in such a way that when the sleeve-type printform is slipped onto the plate cylinder, abrasion of the printform material is avoided.

Pursuant to this object, and others which will become apparent hereafter, one aspect of the present invention resides in a plate cylinder for a sleeve-type print form, which plate cylinder has a ramp-like transition piece with a surface area adapted to be guide surface for mechanical expansion of the sleeve-type form onto a large diameter segment of the cylinder. A slide surface element is arranged at least at the surface area of the ramp-transition piece, which slide surface element is highly resistant to wear and pressure and is made of a different material than the remaining surface portions of the plate cylinder.

Pursuant to a further embodiment of the invention the material of the slide surface element is plastic, and particularly an epoxy-based two-component synthetic resin compound. In yet another embodiment of the invention the slide surface element is made of steel.

Still another embodiment of the invention provides a small diameter cylinder segment connected to the transition piece for precentering the print form. A circumferential ring groove is provided in a surface of the cylinder between the small diameter segment and the large diameter segment and the slide surface element is arranged in the ring groove to form the ramp-like transition piece. In still another embodiment of the invention the slide surface element is shaped as a ring member connected to the large diameter segment. The ring element has a surface that defines a first guide surface for precentering the print form. The ring element also forms the ramp-like transition piece together with the guide surface thereof.

Yet another embodiment of the invention defines the slide surface element to be provided so as to cover the entire outer circumferential surface of the plate cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Since at least the surface region of the plate cylinder which covers the ramp-like transition piece has a highly wear-resistant and pressure-resistant slide surface of a material different than the remaining surface material of the plate cylinder, contact between the printform material and the preferably chrome-coated cylinder surface is prevented during expansion of the printform over the guide surface of the phase piece. Abrasion of the printform is prevented by the slide surface, independent of the anticorrosive surface material of the plate cylinder.

Figure 1:
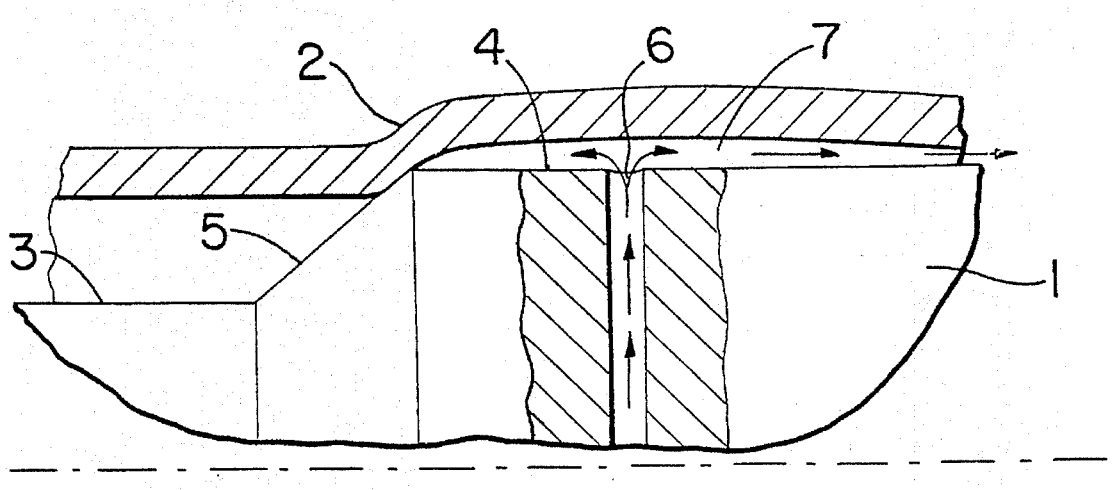
FIG. 1 is a partial longitudinal section of a plate cylinder with a printform without the features according to the present invention.

FIG. 1 shows the prior art from which the invention starts. The cylinder body 1 of the plate cylinder is conventionally designed as a hollow body, which has a wall thickness greater than that of the sleeve-type printform 2. For the most part, the plate cylinder, i.e., its part 4 which carries the printform 2, is constructed with a larger cylinder diameter than the inner diameter of the printform 2. In order to make it easier to slip the printform 2 onto the cylinder body 1, a cylinder piece 3, with a smaller cylindrical diameter than the inner diameter of the printform 2, is located on at least one end face of the plate cylinder. The print form 2 can be precentered on the cylinder piece 3. This cylinder piece 3 is connected via a ramp-like transition piece 5 to the part 4 of the plate cylinder which carries the printform 2, so that the printform 2 can be mechanically expanded over the guide surface of the ramp-like transition piece to the larger plate cylinder diameter. In a known manner, air outlet holes 6 are provided through the cylinder body 1 behind the ramp-like transition piece 5 in the direction in which the printform 2 is slipped on, so that an air cushion 7 can build up underneath the expanded printform 2. The printform 2 can then easily be slipped over the air cushion 7 onto the carrying part 4 of the cylinder body 1.

Figure 2:
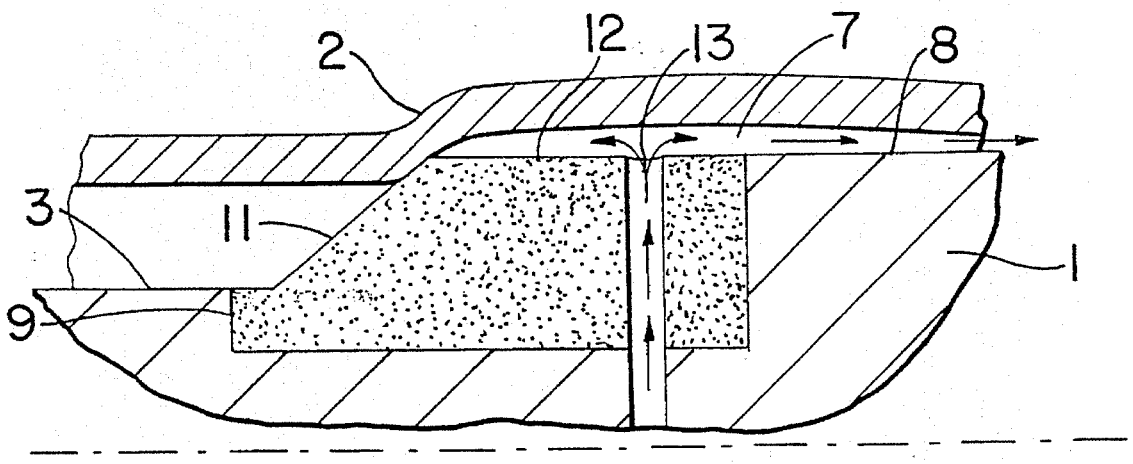
FIG. 2 is a view as in FIG. 1 of an embodiment of the plate cylinder according to the present invention.

FIG. 2 shows a second embodiment of the plate cylinder of FIG. 1 in which a circumferential ring groove 9 is provided on the cylinder surface between the cylinder piece 3 for precentering the printform 2 and the carrying part 8 of the plate cylinder 1. A ramp-like transition piece 11 is introduced into this ring groove 9 as a one-piece slide surface, whereby a portion 12 of its surface runs in alignment with the surface of the carrying part 8 of the plate cylinder 1.

The air outlet holes 13 run, in part, through the transition piece 11 to the surface which is aligned with the carrying part 8.

Figure 3:
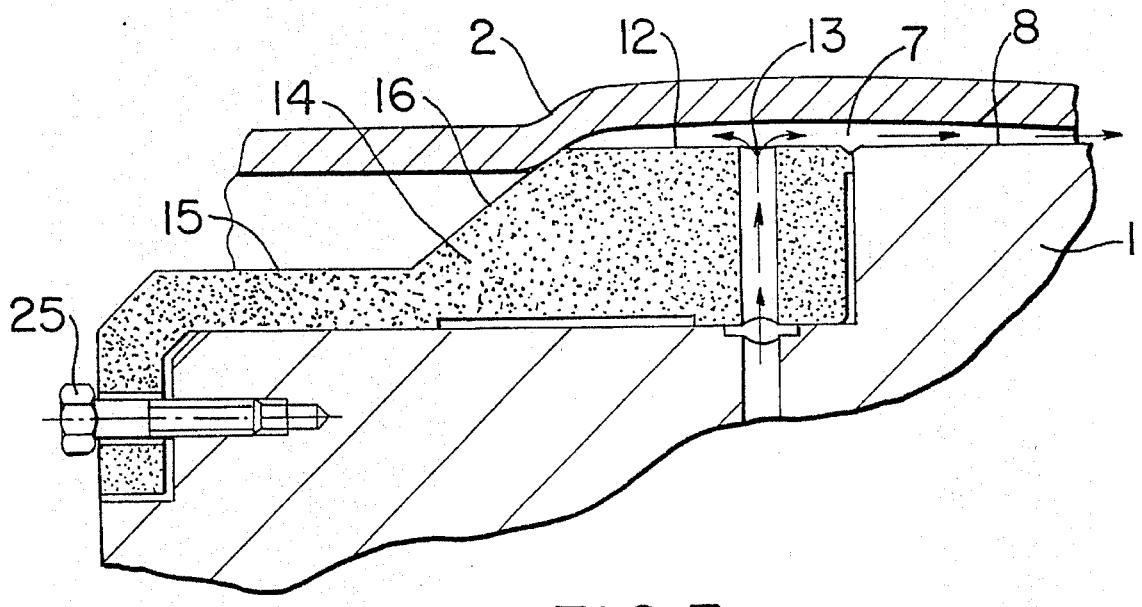
FIG. 3 is a view as in FIG. 2 of a second embodiment of the invention.

In the embodiment according to FIG. 3, the slide surface is a ring element 14 that is screwed together with the plate cylinder body 1 by at least one screw 25. The surface of the ring element 14 encompasses the guide surface 15 for precentering the printform, the guide surface 16 having the ramp-like transition, and a portion 12 of the guide surface that runs in alignment with the surface of the carrying part 8 of the plate cylinder 1, as in the embodiment of FIG. 2. The air outlet holes 13 open into the surface portion 12.

The transition piece 11 can be introduced into the ring groove 9 by molding or deposit welding, while the ring element 14 is produced, for example, by form casting.

Figure 4:
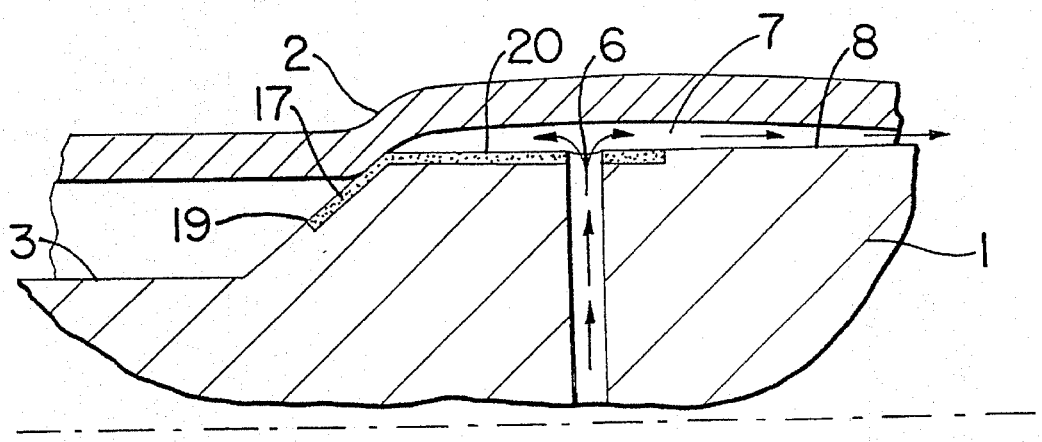
FIG. 4 is a view as in FIG. 2 of a third embodiment of the invention.
Figure 5:
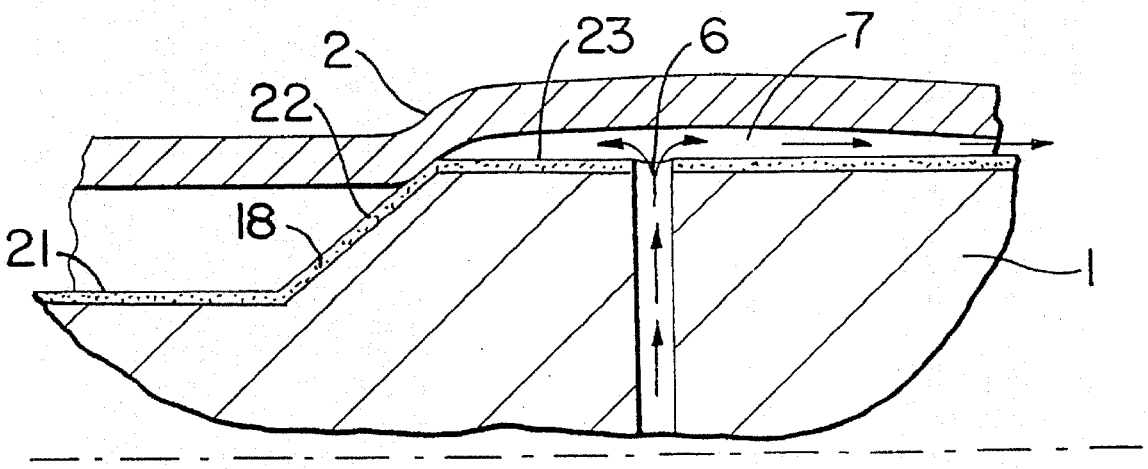
FIG. 5 is a view as in FIG. 2 of a fourth embodiment of the invention.

FIGS. 4 and 5 show a slide surface which is applied as a coating 17, 18. In FIG. 4 the coating 17 partially covers the guide surface of the transition piece 19 and the area 20 of the carrying part 8, in which the air outlet holes 6 open. In FIG. 5 the coating 18 coats the entire circumferential surface of the plate cylinder, i.e., the guide surface for precentering 21, the guide surface of the transition piece 22, and the guide surface of the carrying part 23.

The slide surface element 11, 14, 17, 18 must be highly wear-resistant and pressure-resistant in order to have an acceptable operating life. Preferably, the material used for the slide surface element 11, 14, 17, 18 is a plastic of an epoxy-base two-component synthetic resin compound, i.e., a resin to which a curing agent has been added. However, the material :may also be steel.

The material of the slide surface element 11, 14, 17, 18 can be applied by injection molding or a thermal spraying process, or can be provided as a hard-material coating, particularly PVD coating.

The invention is not limited by the embodiments described above which are presented as examples only but can be modified in various ways within the scope of protection defined by the appended patent claims.

We claim:

1. A plate cylinder for a sleeve-type printform, comprising: a large diameter cylinder segment of a first material for receiving a sleeve-type print form; a ramp-like piece at an end of the cylinder segment and having a surface area for mechanically expanding the sleeve-type print form onto the large diameter cylinder segment; and a slide surface element arranged at least at the surface area of the ramp-like piece, the slide surface element being of a different material than the cylinder segment.

2. A plate cylinder as defined in claim 1, wherein the slide surface element is made of plastic.

3. A plate cylinder as defined in claim 2, wherein the slide surface element is made of an epoxy-base two-component synthetic resin compound.

4. A plate cylinder as defined in claim 1, wherein the slide surface element is made of steel.

5. A plate cylinder as defined in claim 1, and further comprising a small diameter cylinder segment connected to an end of the ramp-like piece opposite the large diameter cylinder segment for precentering the printform.

6. A plate cylinder as defined in claim 1, wherein the slide surface element covers an entire outer circumferential surface of the plate cylinder.

7. A plate cylinder for a sleeve-type print form, comprising:

a large diameter cylinder segment for receiving a sleeve-type print form;

a ramp-like piece at an end of the cylinder segment and having a surface area for mechanically expanding the sleeve-type print onto the large diameter segment; and a ring element arranged at the surface area of the ramp-like piece and connected to the large diameter segment, the ring element having a slide surface that defines a first guide surface for precentering the print form and is of a different material than the remaining portions of the plate cylinder.

8. A plate cylinder as defined in claim 7, wherein the slide surface element and the ramp-like piece are a unitary component.

9. A plate cylinder as defined in claim 7, and further comprising at least one screw that connects the ring element to the large diameter segment.

10. A plate cylinder for a sleeve-type print form, comprising:

a large diameter cylinder segment for receiving a sleeve-type print form;

a ramp-like piece at an end of the cylinder segment and having a surface area for mechanically expanding the sleeve-type print form onto the large diameter segment;

a slide surface element arranged at least at the surface area of the ramp-like piece, the slide surface element being of a different material than remaining portions of the plate cylinder; and a small diameter cylinder segment connected to an end of the ramp-like piece opposite the large diameter cylinder segment for precentering the print form, a circumferential ring groove being provided in a surface of the cylinder between the small diameter segment and the large diameter segment, the slide surface element being arranged in the ring groove and adapted to form the ramp-like piece.

* * * * *